US006571482B1

(12) United States Patent
Tymianski

(10) Patent No.: US 6,571,482 B1
(45) **Date of Patent: *Jun. 3, 2003**

(54) SIGHTING DEVICE FOR PROJECTILE TYPE WEAPONS FOR OPERATION IN DAY AND NIGHT

(75) Inventor: Jacob R. Tymianski, Gainesville, FL (US)

(73) Assignee: Nanoptics, Inc., Gainesville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/962,844

(22) Filed: Sep. 24, 2001

Related U.S. Application Data

(63) Continuation of application No. 09/350,458, filed on Jul. 9, 1999, now Pat. No. 6,385,855.
(60) Provisional application No. 60/092,430, filed on Jul. 10, 1998.

(51) Int. Cl.[7] ..... F41G 1/00; F41G 1/32
(52) U.S. Cl. ..... 33/265; 33/263; 421/132; 421/144; 421/145
(58) Field of Search ..... 33/227, 233, 241, 33/242, 243, 263, 265; 385/901, 31, 123

(56) References Cited

U.S. PATENT DOCUMENTS

| | | | | |
|---|---|---|---|---|
| 3,568,323 | A | 3/1971 | Lendway | |
| 3,579,830 | A | 5/1971 | Morel | |
| 3,641,676 | A | 2/1972 | Knutsen et al. | |
| 3,698,092 | A | 10/1972 | Rosenhan | |
| 3,701,900 | A | 10/1972 | Thuler | |
| 3,706,543 | A | 12/1972 | Thuler | |
| 3,822,479 | A | 7/1974 | Kowalski | |
| 3,834,035 | A | 9/1974 | Merrill | |
| 3,908,055 | A | 9/1975 | Susuki et al. | |
| 3,914,873 | A | 10/1975 | Elliott, Jr. et al. | |
| 4,020,203 | A | 4/1977 | Thuler | |
| 4,177,572 | A | 12/1979 | Hindes | |
| 4,495,705 | A | 1/1985 | Kowalski et al. | |
| 4,695,159 | A | 9/1987 | Cannon | |
| 4,819,611 | A | 4/1989 | Sappington | |
| 4,928,394 | A | 5/1990 | Sherman | |
| 5,001,837 | A | 3/1991 | Bray | |
| 5,065,519 | A | 11/1991 | Bindon | |
| 5,094,002 | A | 3/1992 | Saunders | |
| 5,168,540 | A | 12/1992 | Winn et al. | |
| 5,168,631 | A | 12/1992 | Sherman | |
| 5,201,123 | A | 4/1993 | Booe | |
| 5,359,800 | A | 11/1994 | Fisher et al. | |
| 5,442,861 | A | 8/1995 | Lorocco | |
| 5,493,450 | A | 2/1996 | Elkstrand | |
| 5,820,265 | A | 10/1998 | Kleinerman | |
| 5,862,618 | A | 1/1999 | Brown | |
| 5,901,452 | A | 5/1999 | Clarkson | |
| 5,926,963 | A | 7/1999 | Knight | |
| 5,937,562 | A | 8/1999 | Brough | |
| 5,956,854 | A | 9/1999 | Lorocco | |
| 5,991,479 | A | 11/1999 | Kleinerman | |
| 6,014,830 | A | 1/2000 | Brown et al. | |
| 6,035,539 | A | 3/2000 | Hollenbach et al. | |
| 6,085,427 | A | 7/2000 | Persson | |
| 6,311,405 | B1 * | 11/2001 | Slates | 33/265 |
| 6,366,344 | B1 * | 4/2002 | Lach | 33/265 |

* cited by examiner

*Primary Examiner*—Diego Gutierrez
*Assistant Examiner*—Yaritza Guadalupe
(74) *Attorney, Agent, or Firm*—Saliwanchik, Lloyd & Saliwanchik

(57) ABSTRACT

The subject invention pertains to a method of sighting and a sighting apparatus which can operate during the day and/or night. The subject device can be used on projectile type weapons such as guns and archery products. The subject method and device can be utilized with these various weapons such that a user can use the weapon during the day and/or night and sight under essentially all lighting conditions.

16 Claims, 5 Drawing Sheets

SIGHTING DEVICE FOR PROJECTILE TYPE WEAPONS FOR OPERATION IN DAY AND NIGHT

CROSS-REFERENCE TO A RELATED APPLICATION

The application is a continuation of application U.S. Ser. No. 09/350,458; filed Jul. 9, 1999 , now U.S. Pat. No. 6,385,855 which claims priority from provisional application U.S. S No. 60/092,430; filed Jul. 10, 1998.

BACKGROUND OF THE INVENTION

Aiming sights for weapons have a wide variety of physical configurations. One that is frequently used for gun sights, or many other aiming devices, comprises a pair of open sights, such as U-shaped sights having a horizontal opening of substantial width. This sight is located proximal to the weapon user. The open width of the U-shaped sight must be sufficient to permit sighting of the single distal sight on the weapon. In this case, the user attempts to locate the single distal sight superimposed on the putative target, and simultaneously align that single sight on a horizontal line midway between the two proximal sights. Other sight configurations have been proposed (see, e.g., U.S. Pat. No. 3,698,092). In all sight configurations it is desired to have each sight easily visible under all lighting conditions.

Various types of aiming sights for daylight operation of projectile type weapons are known. Several patents pertaining to such sights include U.S. Pat. Nos. 3,568,323; 3,579,830; 3,822,479; 4,177,572; 4,495,705; 4,819,611; 4,928,394; 5,001,837; 5,094,002; 5,121,462; 5,121,462; 5,168,540; 5,168,631; 5,201,123; and 5,442,861. More recently, there has been interest in the use of plastic optical fibers in such sights. These plastic optical fibers can incorporate a dye which absorbs ambient light and then emits fluorescent light. A fraction of the fluorescent light which is emitted can then be channeled by the plastic optical fiber and exit from the end of the fiber pointing toward the user of the weapon.

Similarly, there has been a variety of sights used for nighttime self-illumination of sights. Several patents pertaining to such sights include U.S. Pat. Nos. 3,641,676; 3,698,092; 3,701,900; 3,706,543; 3,834,035; 3,908,055; 3,914,873; 4,020,203; 4,695,159; 5,065,519; and 5,359,800.

These sights frequently use one or more radioluminous light sources located, for example, in a recess, so as to expose the user of the weapon to the luminous light but conceal the luminous light from other points of view. These radioluminous light sources have frequently used material compositions comprising tritium. Other light sources have also been used such as electrically powered light emitting diodes, chemofluorescent light sources, and long lived phosphorescent light sources.

There have been attempts to produce aiming sights which can operate in both day and night lighting conditions. Most notable is the approach of Fisher, disclosed in U.S. Pat. No. 5,359,800. Fisher discloses a sight having a radioluminescent light source which is surrounded by a light reflective paint. During the day, the paint reflects light to the user so as to provide the appearance of a colored light ring. During the night the radioluminescent light source produces light which is directed toward the user. However, the daylight reflected light from the Fisher sight can be quite low. In fact, in medium to low light level conditions, the reflected light can be inadequate. Furthermore, the radioluminescent light can be too low relative to the ambient light level to provide adequate light for the user of the weapon.

It is a purpose of the present invention to describe a sighting device which can provide adequate light for a weapon user under all lighting conditions.

BRIEF SUMMARY OF THE INVENTION

The subject invention pertains to a method of sighting and a sighting apparatus which can operate during the day and/or night. In a preferred embodiment, the subject sight will be able to operate in essentially any lighting conditions. The subject invention also relates to sighting systems incorporating a plurality of individual sights in a variety of physical configurations.

In accordance with the subject invention, an illumination source can be aligned along the axis of a fluorescent optical fiber and optically connected thereto. The unique design of the fluorescent fiber is such as to permit essentially total light transmission from the illumination source through the fiber towards the weapon user, and at the same time emit adequate fluorescent light intensity from its end towards the user even under adverse lighting conditions. The subject invention also pertains to various embodiments of a fluorescent fiber which can be utilized in this way.

DETAILED DISCLOSURE OF THE INVENTION

The subject invention pertains to a method of sighting and a sighting apparatus which can operate during the day and/or night. In a preferred embodiment, the subject sight will be able to operate in essentially any lighting conditions. The subject invention also relates to sighting systems incorporating a plurality of individual sights in a variety of physical configurations.

Figure 1:
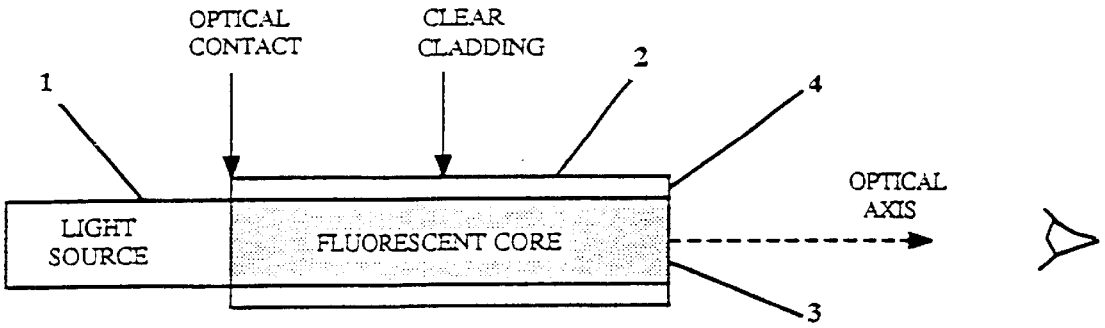
FIG. 1 is a longitudinal sectional view of a day and night sight in accordance with the subject invention.

Referring to FIG. 1, an embodiment of the subject invention is shown having a light source 1 and fiber optic component 2. Light source 1 can be any light source which may operate with no ambient lighting present. Specific examples of light source 1 include radioluminescent or battery powered light sources. Fiber optic component 2 can be positioned to receive light emitted from light source 1. To enhance the reception of light from light source 1, fiber optic component 2 can be connected to light source 1. This connection preferably involves optical contact and more preferably connection with a common axis. Although embodiments wherein light source 1 and fiber optic component 2 are positioned such that they share a common axis are exemplified in the subject disclosure, the subject invention also relates to alternative embodiments where light source 1 and fiberoptic component 2 do not share a common axis. In these embodiments, light source 1 can be positioned with respect to fiber optic component 2 such that a portion of the light emitted from light source 1 is coupled into and emitted from the end of fiber optic component 2. Additional components, for example mirrors and/or prisms, can be utilized to assist in the coupling of the light from light source 1 into fiber optic component 2.

Fiber optic component 2 can preferably be rotationally symmetric about the axis. Shapes other than that of transverse circularity, for example square, are also possible. For example, it may be preferred to have a polygonal shape when a flat surface is needed on the exterior of fiberoptic component 2 to enhance the coupling of light from light source 1. The fiber optic component 2 can have a fluorescent material within core 3 and a clear, essentially transparent cladding material 4 in optical contact with the core. The refractive index of the cladding material can be less than that of core 3 to enhance the guiding of the light which enters the end of fiber optic component 2. Optionally, a lens, or curved surface, can be incorporated at the output end of the fiber to focus the output light toward the user.

Figure 2:
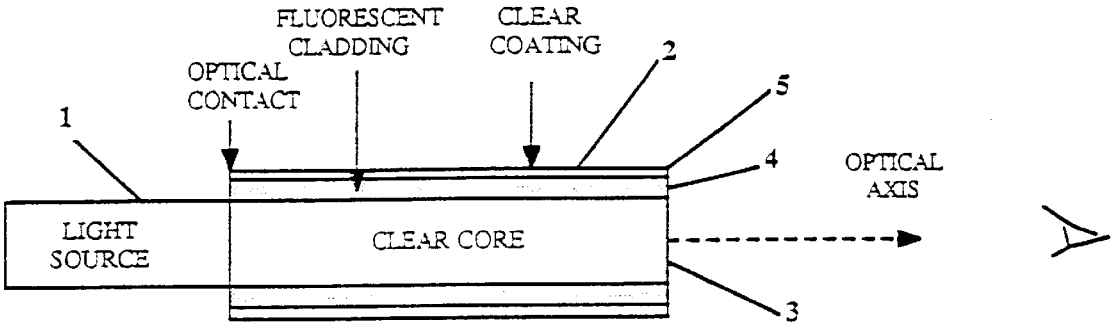
FIG. 2 is a longitudinal sectional view of a day and night sight showing a preferred embodiment of the subject invention.

Another specific embodiment of the subject invention is shown in FIG. 2. In this embodiment, fiber 2 can have a clear, transparent core section 3. Around the core, a cladding region 4 can be arranged in optical contact with the core. The cladding material can have a fluorescent material within and can absorb ambient light which impinges upon cladding 4. The light energy of the absorbed ambient light can be subsequently re-emitted by the cladding material at a different wavelength. A protective coating 5, for example of clear material, can surround cladding 4 and can protect fiber optic component 2 from humidity, corrosive gases and liquids which may come in contact with the fiber optic element.

Figure 3:
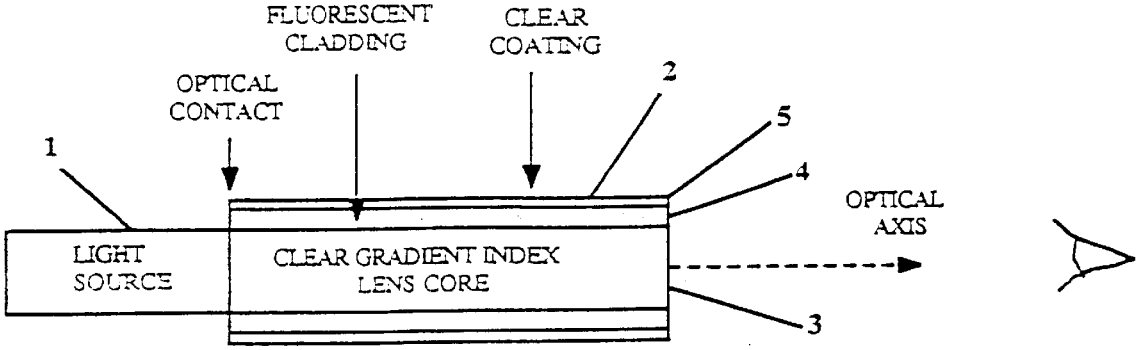
FIG. 3 is a longitudinal sectional view of a day and night sight showing a more preferred embodiment of the subject invention.

An additional specific embodiment of the subject invention is shown in FIG. 3. In this case, core material 3 can be clear and formed so as to have a graded refractive index profile, for example, which is high along its axis but reduces as a function of distance transverse to the axis. Such optical fiber is well known as gradient index (GRIN) fibers in the field of fiber optic telecommunications. In this case, core material 3 can act as a lens and collect light emitted from light source 1. This core material can then efficiently project the light out of the fiber optic element 2, along the optic axis towards the user. The cladding material 4, and coating material 5 can be similar to that described with respect to the embodiment shown in FIG. 2.

Additional embodiments can have other combinations of cladding, core, and/or coating where one, more, or all are formed of a material able to fluoresce and/or have a fluorescent material added therein. The amount of fluorescent material should be enough to generate adequate light for proper sighting in the ambient light conditions under which the subject sighting apparatus is to be used. For example, it may only be necessary to have fluorescent materials in a portion of the cladding, core, and/or coating for a particular application. In a specific embodiment, a fiber optic component 2 can utilize a GRIN fiber core to focus the light emitted from fiber optic component 2 parallel to the optic axis of the GRIN fiber core such that a user will see a bright point of light to aim, even with low ambient light. This GRIN fiber core can be used without a light source and still provide sufficient brightness even in low ambient light conditions. This can provide a much brighter point of light than step-index fiber optic components which emit light in many more directions from the end of the fiber optic component 2. In a specific embodiment, the GRIN core can incorporate a fluorescent material. Also, a cladding and/or coating, with or without fluorescent material, can be added to the GRIN core.

The materials of the fiber optic element 2 may be of glass, polymer or other transparent matrix able to fluoresce or have fluorescent material added therein. Preferably, the material of the core can be fabricated with a radially varying refractive index. It is well known in the art, that glass can be made to have all of these properties. Glass also has a brittleness which under some circumstances may increase its chance of breakage. However, glass is highly resistant to corrosive vapors, liquids and humidity. Polymeric material can also be transparent, fluorescent (see e.g., U.S. Pat. No. 5,638,604) and fashioned into GRIN fiber. Examples of polymers which can be used for core and cladding materials include polymethylmethacrylate, polystyrene, polycarbonate, polyacrylonitrile and copolymers and blends thereof. Other amorphous polymers, or blends of polymers with additives may also be used. The choice of coating polymers, whose function is to confer protection, may preferably be from the amorphous fluorinate class or the amorphous perfluorinated class. Examples of the amorphous fluorinate class polymers include such polymers as polytrifluoromethylmethacrylate and other fluorinated esters of methacrylic acid. Examples of the amorphous perfluorinated class polymers include polymers such as Teflon AF (available from DuPont) and Cytop (available from Asahi Glass).

Following are examples which illustrate procedures for practicing the invention. These examples should not be construed as limiting.

EXAMPLE 1

Figure 4:
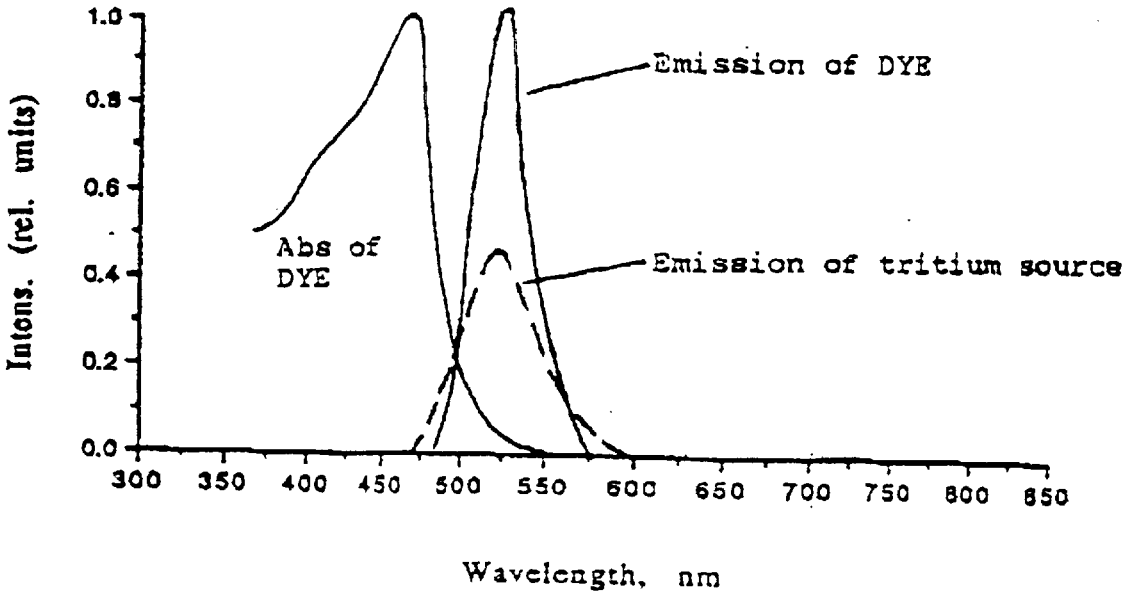
FIG. 4 is a diagram showing the absorption and emission spectra of a typical green dye which can be utilized in the fiber of the device shown in FIG. 1 and the typical emission spectrum of a tritiated radioluminous green light source.

The embodiment shown in FIG. 1 can operate with no ambient light by transmitting the light from the source 1 through the fluorescent core material 3 of the fiber optic element. Since the intensity of light from some sources, such as a radioluminescent source, is not high, the efficacy of light transmission through the core material 3 can be of great importance. In FIG. 4, the absorption and emission spectra are shown of a typical green dye in a fluorescent polymeric material. Also shown is the typical emission spectrum of a tritiated gaseous radioluminescent green light source. It can be seen that there is a partial overlap of the light source emission spectrum and the absorption spectrum of the dye. The result is that some of the light source intensity is lost by absorption in the core and a weaker light intensity is seen by the user of the sight. Typical dyes used in fluorescent fibers of this type is Lisa Green or Yellow 083.

Figure 5:
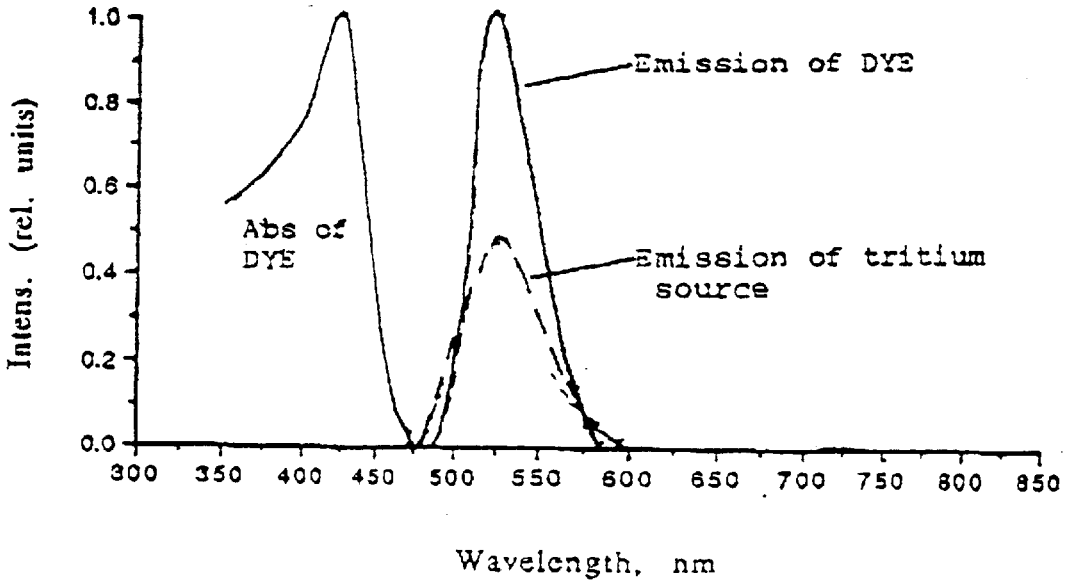
FIG. 5 is a diagram showing the spectra for an optimized green dye which can be utilized in the fiber of the device shown in FIG. 1.

In FIG. 5 the spectra of a special class of green dyes, known as Large Stokes Shift dyes, is shown along with the emission spectrum of the light source. In this case, the light intensity from the source is much more readily transmitted by the fluorescent fiber. The user of the sight can then more easily see the sight in the night. During the day, the fluorescence of the fiber is quite adequate. However, since the dye's absorption spectrum has been shifted towards the blue end of the spectrum of ambient light, there is not as much ambient light available for absorption as in the standard green dyes. Thus, this embodiment provides good night vision, and adequate vision for operation in poor, medium and strong daylight.

Figure 6:
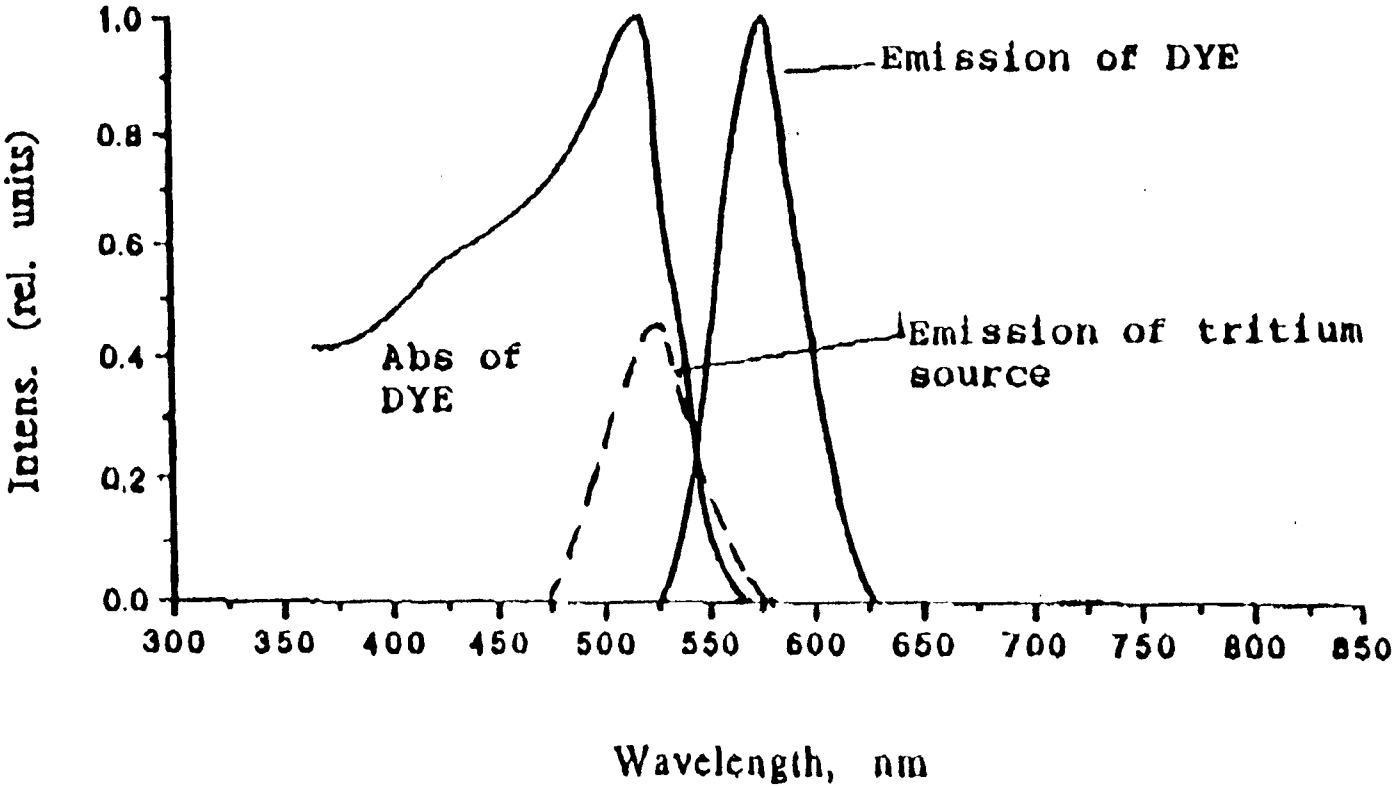
FIG. 6 is a diagram showing the absorption and emission spectra of a typical yellow dye which can be utilized in the fiber of the device shown in FIG. 1 and the typical emission spectrum of a tritiated radioluminous yellow light source.

The subject sights, for example as shown in FIG. 1, can produce colors other than green as well. In FIG. 6 the absorption and emission spectrum of a typical Large Stokes Shift yellow dye is shown together with a typical spectrum of a tritiated radioluminous gas yellow light source. It can be seen that some of the yellow source light is absorbed by the yellow fluorescent fiber core. In addition to this absorption, the intensity of yellow light emitted by such a source is significantly less than that of a corresponding green source. For these reasons, a yellow sight in this embodiment is not preferred. Similarly remarks can be made for a red sight.

EXAMPLE 2

Figure 7:
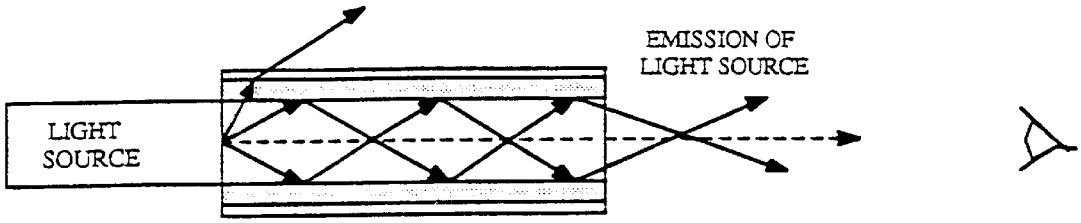
FIG. 7 is a diagram showing the nighttime mode operation of a sight utilizing fiber with a fluorescent cladding and a clear core.
Figure 8:
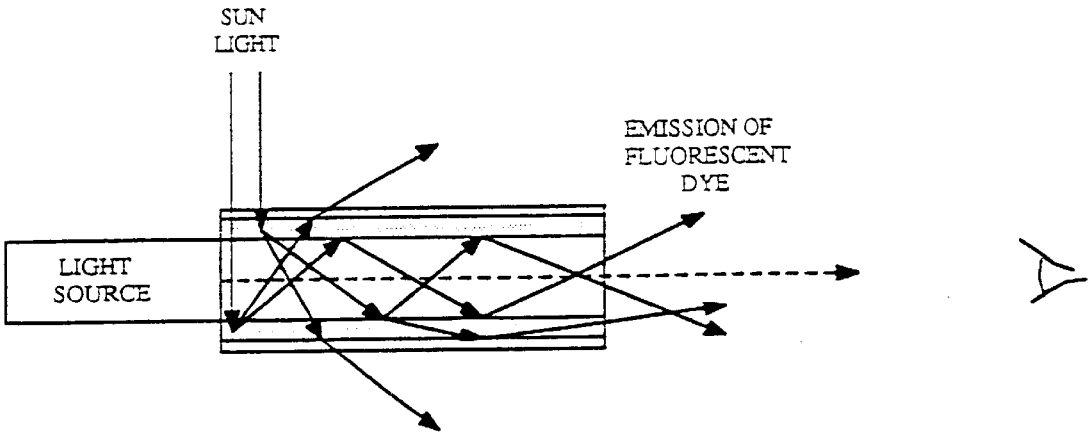
FIG. 8 is a diagram showing the day time mode operation of a sight utilizing fiber with a fluorescent cladding and a clear core.

FIG. 2 illustrates an embodiment of the subject invention with enhanced output light intensity and variety of colors of the embodiment described in Example 1. FIG. 7 illustrates the nighttime mode operation of the sight of FIG. 2. Light from the light source is essentially unattenuated by the clear, transparent core of the fiber as illustrated in FIG. 7. This high light transmission is true in the case of colors in the visible range, for example green, yellow, or red light sources. Thus, very good night vision can be achieved for any color with this type of sight design. In strong ambient light, the fluorescent light emitted from the fiber cladding, guided through the fiber, and emitted towards the user provides excellent sight vision as illustrated in FIG. 8. In very poor ambient light, the combination of light from the light source plus weak fluorescent light from the fiber produces a very good light intensity, and contrast, for the user. The fluorescent light from the fiber may be of the same or different color from that of the source. In this way, the full range of color options are available and all with very good to excellent light intensity under all ambient light conditions.

EXAMPLE 3

FIG. 3 illustrates an embodiment of the subject invention which can increase the light intensity from the light source. In the case of some sources, such as radioluminescent, it is often preferred to improve the intensity of light reaching the user. A GRIN lens with, for example, a parabolic refractive index profile can be used as the transparent core of the fiber optic element. This lens can gather light emitted from the light source and direct it towards the user. The refractive index radial profile of the lens can be characterized as:

$$n(r) = \begin{cases} n_1[1 - 2\Delta(r/a)^g]^{1/2} & r \le a \\ n_2 & r > a \end{cases}$$

where r is the radial distance from the lens axis, a is the radius of the lens, $n_1$, and $n_2$ are the refractive indices at r=0 and r=a, the parameter g controls the index profile as a function of radius, $n_1 \geqq n_2$, and $2\Delta=(n_1^2-n_2^2)/n_1^2$. In the particular case where g=2, the profile is described as parabolic.

In a specific embodiment, a GRIN lens comprising a fluorescent compound can be used as the fiber optic component, with no cladding, or coating, as the light is guided by the GRIN lens. Although, a coating can still be useful for protecting the GRIN lens from the environment.

Figure 9:
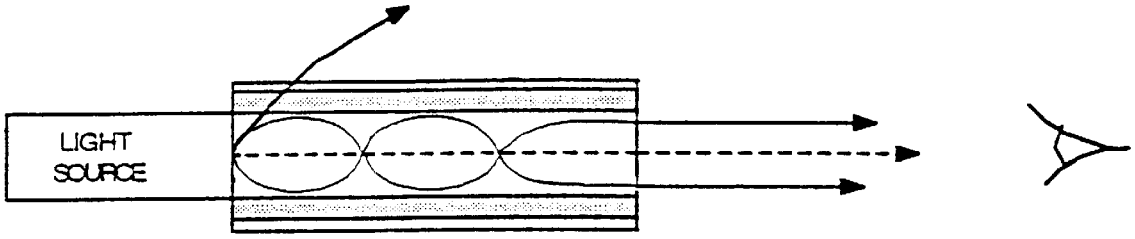
FIG. 9 is a diagram showing the nighttime mode operation of a sight utilizing a GRIN fiber optic as shown in FIG. 3.

Typical trajectories of light emitted from the center of the light source for sights utilizing a GRIN lens are illustrated in FIG. 9. The initial angles of these light trajectories are identical to those shown in FIG. 7 for a uniform index core. In the latter case, light rays emitted within the angular range $0^0$ to an acceptance angle, typically about $30^0$, relative to the optic axis are contained within the fiber by multiple reflections as shown in FIG. 7. The value of the acceptance angle is dependent on the relative refractive indices of the core and cladding materials and/or the dimensions of the fiber optic. Typical polymeric materials as discussed earlier lead to an acceptance angle value of about $30^0$. For emission angles greater than the acceptance angle, the light cannot be contained within the fiber and typically emerges from the side of the fiber optic element as shown in FIG. 7. When the light rays, emitted within the angular range $\mathbf{0}^0$ to the acceptance angle, emerge from the end of the fiber, the angular range increases due to refraction at the polymer to air interface. As these light rays travel towards the user, their radial distance from the optic axis typically increases. For example, at the transverse plane containing the users eye at a longitudinal distance of twelve (12) inches form the site, the radial distance of a $30^0$ initial ray is about seven (7) inches. In FIG. 9, similarly emitted rays from the source are bent by the GRIN lens so as to emerge from the end of the fiber at small angles. Furthermore, the length of the GRIN fiber can be chosen to be a "Quarter Pitch" or (2n+1) multiples thereof (where n is an integer), which is that critical length which produces parallel rays towards the user. A quarter pitch of a GRIN fiber is defined as:

$$\frac{\pi}{4} \cdot \frac{a}{\sqrt{\Delta}}$$

The length of a quarter pitch of fiber core is typically about 1 cm but can be adjusted in the fiber manufacturing process in the range of about 0.5 to about 5 cm. In the case of a quarter pitch length fiber, the light tends to be focused parallel to the optic axis as it propagates towards the user. As a result, for a given light source intensity, the light intensity seen by the user is typically greater when a GRIN fiber core is utilized, as compared with a uniform index core. While the light intensity is increased over a small area around the optic axis, enhancing visibility, there is the potential that the sight will be dimmer when the eye is significantly off the optic axis. Thus, the ease of aligning the weapon may suffer if the light focusing along the optic axis is too great.

It is important that the design of a sight take into account and balance the need for rapid weapon alignment and the need for brightness of the sight. The embodiment illustrated in FIG. 3 provides the designer the ability to optimize this balance. The optimization process can be done by adjusting the strength of the lens through the GRIN profile and/or by choosing different lengths of fiber.

Operation of the embodiment illustrated in FIG. 3 under ambient light conditions is similar to the operation of the sight of FIG. 2 under ambient light conditions.

In summary, the embodiment illustrated in FIG. 3 is preferred and offers the designer much control over the nighttime brightness of the sight as a function of alignment of the weapon. Accordingly, very good nighttime brightness can be achieved in any color. As with the embodiment illustrated in FIG. 2 the sight brightness during poor, medium and bright ambient light is very good to excellent and all colors are possible.

EXAMPLE 4

This embodiment of the fiber optic sight concerns the physical design of the holder for both the light source and the fiber. In this regard, this embodiment applies to all three physical embodiments of source and fiber of the previous three examples.

Figure 10:
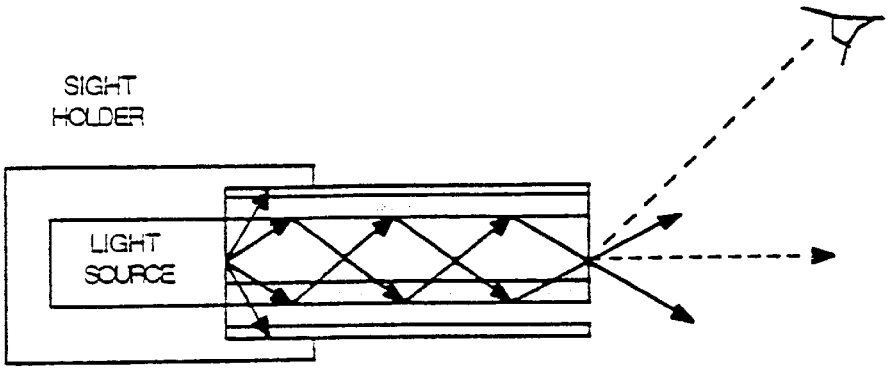
FIG. 10 is a diagram showing the nighttime mode of operation of the sight shown in FIG. 7 when the sight is encased in recessive holder.

As illustrated in FIG. 10, the sight holder is configured such that the light source is recessed within the holder, and the holder also covers a portion of the fiber. Preferably, the holder covers the portion of the end of the fiber where the large portion of light entering the fiber at greater than the acceptance angle will escape from the fiber end such that the user does not see the escaped light. The specific sight shown in the sight holder of FIG. 10 is the sight illustrated in FIG. 2. When the weapon alignment is not correct, as shown in FIG. 10, the user sees one point, at the end of the fiber from which light emerges. The user can also see the single points of light from the other sights in the complete sighting system. The user then aligns the single points of light in the manner prescribed for that particular sighting system. The weapon is then pointing at the target. This embodiment has the advantage that the method of weapon alignment is identical for night and day operation since in both cases each single sight produces a single point of light.

EXAMPLE 5

This embodiment pertains to a different design of the site holder from that of the embodiment of Example 4 and also applies to the sights of Examples 1, 2, and 3.

Figure 11:
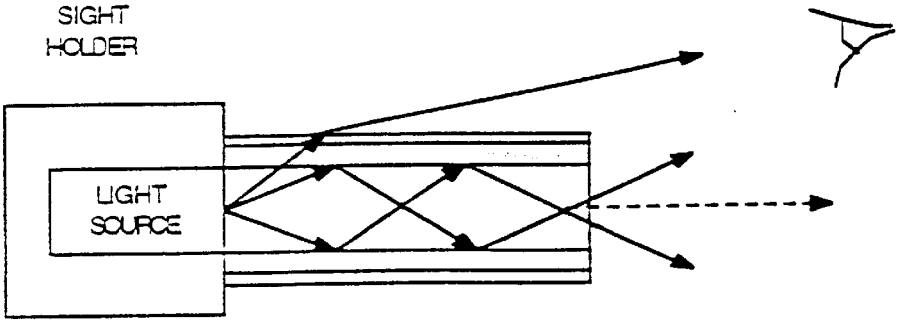
FIG. 11 is a diagram showing the nighttime mode of operation of the sight shown in FIG. 7 when the sight is encased in non-recessive holder.

As shown in FIG. 11, the sight holder is configured such that the light which is emitted from the light source and escapes through the fiber cladding is not blocked by the holder, such that this escaped light can reach the user's eye. As in FIG. 10, the specific sight shown in FIG. 11 is that given in FIG. 2 and is illustrative of the design. Accordingly, when the weapon alignment is not correct, as shown in FIG. 11, the user sees two points of light. One point is that of the light source itself due to light at large angle emerging from the side of the fiber. The other point of light is the end of the fiber from which light is emerging. These two points of light can be quite distinct form each other. The lateral displacement of the two points provides the user of the weapon an instant measure of the degree of misalignment and the direction of misalignment as well. The user then adjusts the alignment of the weapon to minimize the apparent lateral displacement of the two points of light until they overlap. At that point, the user has achieved proper weapon alignment. This embodiment has the advantage that weapon alignment can be achieved with a single sight. In practice, this alignment procedure is rapid but not highly accurate due to the short distance between the two points of light.

Most sighting systems employ a set of single sights. When a misaligned weapon with a set of sights, each with the embodiment described here, is viewed by the user, a set of pairs of points of light is observed. Rapid approximate alignment is achieved by moving the weapon to reduce the pairs of points of light to single points of light. At that time, final accurate weapon alignment is achieved in the manner prescribed for the complete sighting system.

It should be understood that the examples and embodiments described herein are for illustrative purposes only and that various modifications or changes in light thereof will be suggested to persons skilled in the art and are to be included within the spirit and purview of this application.

What is claimed is:

1. A sighting device, comprising:

a light source; and a fiber optic component, wherein said fiber optic component comprises a core and a cladding, wherein said core is clear, wherein said cladding comprises a fluorescent material which emits fluorescent light upon absorption of ambient light such that at least a portion of said emitted fluorescent light is emitted from a first end of said fiber optic component, wherein said light source is optically coupled to said fiber optic component such that at least a portion of the light emitted from said light source is coupled into said fiber optic component and is emitted from said first end of said fiber optic component.

2. The sighting device according to claim 1, wherein said light source emits light even with no ambient light present.

3. The sighting device according to claim 1, wherein said light source is selected from the group consisting of a light emitting diode, a chemofluorescent light source, a long-lived phosphorescent light source, and a radioluminescent light source.

4. The sighting device according to claim 1, wherein said light source is in optical contact with said fiber optic component.

5. The sighting device according to claim 1, wherein an axis of said light source and an axis of said fiber optic component lie on the same line.

6. The sighting device according to claim 1, further comprising a means for focusing the light emitted from said first end.

7. The sighting device according to claim 1, wherein said fiber optic component further comprises a protective coating.

8. The sighting device according to claim 1, wherein said core has a uniform refractive index.

9. The sighting device according to claim 1, wherein said core has a graded refractive index profile.

10. The sighting device according to claim 9, wherein said core acts as a lens to collect light emitted from the light source.

11. The sighting device according to claim 9, wherein said core focuses light emitted from the fiber optic component such that the emitted light is parallel to the optic axis of the core.

12. The sighting device according to claim 11, wherein said light emitted by the light source is optically coupled to a second end of said fiber optic component, and wherein said fiber optic component has a length given by $$(2n+1)\frac{\pi}{4}\cdot\frac{a}{\sqrt{\Delta}}$$

where n is an integer.

13. The sighting device according to claim 12, further comprising a holder.

14. The sighting device according to claim 13, wherein the holder covers a portion of the fiber optic component such that at least a portion of the light entering the fiber optic component from the light source at angles greater than the acceptance angle of the fiber optic component is blocked.

15. The sighting device according to claim 1, wherein said fluorescent material is a fluorescent dye.

16. The sighting device according to claim 15, wherein said fluorescent dye is selected from the group consisting of a Lisa Green, a Yellow 083, a Large Stokes Shift green dye, and a Large Stokes Shift yellow dye.

* * * * *